US011350752B2

(12) United States Patent
Kong

(10) Patent No.: US 11,350,752 B2
(45) Date of Patent: Jun. 7, 2022

(54) SYSTEMS AND METHODS FOR A PORTABLE CHAIR WITH SUNSHADE

(71) Applicant: GoPlus Corp., Fontana, CA (US)

(72) Inventor: Xujuan Kong, Ningbo (CN)

(73) Assignee: GOPLUS CORP., Fontana, CA (US)

( * ) Notice: Subject to any disclaimer, the term of this patent is extended or adjusted under 35 U.S.C. 154(b) by 0 days.

(21) Appl. No.: 16/986,089

(22) Filed: Aug. 5, 2020

(65) Prior Publication Data

US 2021/0145179 A1 May 20, 2021

Related U.S. Application Data

(63) Continuation-in-part of application No. 29/713,823, filed on Nov. 19, 2019.

(51) Int. Cl.
*A47C 1/14* (2006.01)
*A47C 11/00* (2006.01)
(Continued)

(52) U.S. Cl.
CPC ..... *A47C 1/14* (2013.01); *A47C 4/286* (2013.01); *A47C 7/622* (2018.08); *A47C 7/66* (2013.01);
(Continued)

(58) Field of Classification Search
CPC .. A47C 1/14; A47C 7/622; A47C 7/66; A47C 4/286; A47C 11/005; B65D 81/3813
(Continued)

(56) References Cited

U.S. PATENT DOCUMENTS 6,193,308 B1 2/2001 Hwang
7,243,990 B1 7/2007 Wahl
(Continued)

FOREIGN PATENT DOCUMENTS

WO 2006/099718 A1 9/2006

OTHER PUBLICATIONS

Extended European Search Report dated Dec. 15, 2021, from corresponding European application No. 21183217.5.
(Continued)

*Primary Examiner* — Anthony D Barfield
(74) *Attorney, Agent, or Firm* — Troutman Pepper Hamilton Sanders LLP; Louis J. DelJuidice; Korbin M. Blunck

(57) ABSTRACT

The disclosed technology can include a dual chair folding system having rigid support poles joined by pins to form a collapsible chair support frame. Fabric sections can be affixed to the collapsible chair support frame to form a plurality of chairs. The dual chair folding system can also include vertical support poles and sunshade support poles that can be joined by pins to form a collapsible sunshade support frame. A continuous fabric section can be affixed to the collapsible sunshade support frame to form a sunshade positioned above the collapsible chair support frame. Attachment brackets can be attached to the collapsible chair support frame to receive the sunshade support frame such that the collapsible sunshade support frame can be removeably attached to the collapsible chair support frame. Furthermore, adjustable brackets affixed to the vertical support poles and the sunshade support poles can adjust the sunshade between a plurality of angles.

20 Claims, 13 Drawing Sheets

(51) Int. Cl.

| | |
|---|---|
| ***A47C 7/66*** | (2006.01) |
| ***A47C 7/62*** | (2006.01) |
| ***A47C 4/28*** | (2006.01) |
| ***B65D 81/38*** | (2006.01) |

(52) U.S. Cl.
CPC ..... *A47C 11/005* (2013.01); *B65D 81/3813* (2013.01)

(58) Field of Classification Search
USPC ..... 297/184.15, 184.17
See application file for complete search history.

(56) References Cited

U.S. PATENT DOCUMENTS

| | | | | |
|---|---|---|---|---|
| 7,347,217 | B2 * | 3/2008 | Bree | A47G 9/1045 135/117 X |
| 7,648,196 | B2 * | 1/2010 | Degel | |
| 2005/0067864 | A1 * | 3/2005 | Anglin | A47C 4/04 297/184.15 X |
| 2007/0236058 | A1 | 10/2007 | Yeider | |
| 2010/0102600 | A1 | 4/2010 | Lovley | |

OTHER PUBLICATIONS

GoPlus, "GoPlus Double Folding Picnic Chairs w/Umbrella Mini Table Beverage Holder Carrying Bag for Beach Patio Pool Park Outdoor Portable Camping Chair", www.amazon.com, pp. 1-2, Aug. 2020.

Trademark Innovations, "Trademark Innovations Double Folding Camp and Beach Chair with Removable Umbrella and Cooler", www.amazon.com, p. 1, Aug. 2020.

Alpha Camp, "Alpha Camp Heavy Duty Canopy Lounge Chair Sunshade Hiking Travel Chair with Cup Holder Enamel Blue", www.amazon.com, pp. 1-2, Aug. 2020.

Quick Shade, "Quick Shade MAX Shade Chair, Navy", www.amazon.com, p. 1, Aug. 2020.

Rio Brands, "Rio Gear Hi-Boy 17" Extended Seat Height Folding Aluminum Canopy Chair—Blue Sky/Navy, www.amazon.com, p. 1, Aug. 2020.

* cited by examiner

SYSTEMS AND METHODS FOR A PORTABLE CHAIR WITH SUNSHADE

CLAIM OF PRIORITY

This application is a continuation-in-part, and claims benefit under 35 USC § 120, of U.S. Non-provisional Design patent application Ser. No. 29/713,823 filed 19 Nov. 2019 which is fully incorporated herein by reference.

FIELD

Examples of the present disclosure relate to portable chairs that can be folded for transportation and storage and, more particularly, portable chairs having a sunshade.

BACKGROUND

Portable chairs are commonly used to create a comfortable seating arrangement without needing to transport cumbersome furniture. Portable chairs, typically consisting of lightweight poles and a metal or fabric seat, can be folded or otherwise collapsed to conveniently move the portable chair from one location to another. For example, many individuals use portable chairs outdoors during activities such as camping, attending sporting events, fishing, going to the beach, attending large outdoor gatherings, or other activities where sitting is desirable but chairs or other furniture are not normally present.

Because portable chairs are often used outdoors, many users find themselves exposed to the sun's harmful rays while using the portable chair in locations where shade is unavailable (e.g., while at a sporting event or at the beach). One solution to this problem is to use a portable umbrella to provide shade by placing the umbrella near the portable chair. However, using a portable umbrella can be undesirable because it requires the user to transport additional items to the seating location and the umbrella is often unable to provide enough shade to adequately block the sun's harmful rays. Furthermore, the portable chairs are often used in locations where placing an umbrella near the portable chair may not be feasible (e.g., when using the chair on pavement where the umbrella cannot be inserted into the ground).

Many users of portable chairs also transport food items in containers, such as coolers, so that they can enjoy food or drink while using the portable chair. The user generally places the cooler near the portable chair so that the food is within a convenient reaching location. Placing the cooler near the portable chair, however, can create a dangerous tripping hazard or cause the user to tip the portable chair over while reaching for a food item or drink in the cooler.

What is needed, therefore, is a portable chair that can provide protection from the sun's harmful rays while also storing food or drinks in a convenient and safe location. The solution of this disclosure resolves these and other problems in the art.

SUMMARY

Accordingly, the inventors of this disclosure have recognized that there is a need for the following solution.

In some examples, a dual folding chair system can include a first plurality of rigid support poles joined by pins to form a collapsible chair support frame. The dual folding chair system can include a plurality of fabric sections affixed to, and suspended by, the collapsible chair support frame to form a plurality of chairs. Each chair of the plurality of chairs can be configured to support a user when in a deployed state.

The dual chair folding chair system can further include a second plurality of rigid support poles joined by pins to form a collapsible sunshade support frame. The second plurality of rigid support poles can include a plurality of vertical support poles and a plurality of sunshade support poles. A continuous fabric section can be affixed to, and supported by, the collapsible sunshade support frame to form a substantially planar and substantially rectangular sunshade positioned above the collapsible chair support frame when in a deployed state. A plurality of attachment brackets can be attached to the collapsible chair support frame and configured to receive the plurality of vertical support poles of the collapsible sunshade support frame such that the collapsible sunshade support frame can be removeably attached to the collapsible chair support frame. Furthermore, a plurality of adjustable brackets can be affixed to the plurality of vertical support poles and the plurality of sunshade support poles.

The plurality of adjustable brackets can be configured to adjust the sunshade between a plurality of angles such that the plurality of sunshade support poles can be rotated substantially 90 and/or 180 degrees in relation to the plurality of vertical support poles between a deployed state and a collapsed state. Each of the plurality of adjustable brackets can include an adjustable angle bracket with a plurality of holes configured to receive a locking pin. Alternatively, or in addition, each of the plurality of adjustable brackets can include an adjustable angle bracket with a plurality of holes configured to receive a spring-loaded releasable push button. Further still, each of the plurality of adjustable brackets can include bracket connections having raised edges that can be configured to align with raised edges of a corresponding bracket connection to prevent the sunshade support poles from moving in relation to the vertical support poles. The bracket connections, when the raised edges of each bracket connection are aligned with the raised edges of the corresponding bracket connection, can be secured in place with a threaded connection. Alternatively, the bracket connections, when the raised edges of each bracket connection are aligned with the raised edges of the corresponding bracket connection, can be secured in place with a spring-loaded tension knob.

The collapsible sunshade support frame can be collapsed with the collapsible chair support frame while attached to the collapsible chair support frame. Similarly, the collapsible sunshade support frame can be deployed with the collapsible chair support frame while attached to the collapsible chair support frame.

The plurality of chairs can include a breathable mesh material configured to facilitate heat dissipation. Furthermore, the plurality of fabric sections can include a reinforcing fabric proximate the collapsible chair support frame to provide support to the plurality of fabric sections.

The dual folding chair system can include a compartment configured to hold objects when in a deployed state. The compartment can be a cooler configured to provide thermal insulation to an object stored within the compartment and include a top opening for a user to access the object within the cooler. The top opening can include a zipper, a hook and loop fastener, and/or a magnetic fastener. The compartment can include a pocket affixed to an outer surface of the cooler to hold an object.

In another example of the disclosed technology, a method of erecting a chair can include gripping opposing ends of the portable chair and pulling outwardly until a plurality of chairs are deployed. The method can further include gripping opposing ends of a sunshade frame and pulling outwardly until the sunshade frame is extended, aligning a plurality of vertical support poles of the sunshade frame with a plurality of attachment brackets of the plurality of chairs, and inserting the plurality of vertical support poles into the plurality of attachment brackets. The method can also include releasing a plurality of adjustable brackets of the sunshade frame, gripping a plurality of upper poles of the sunshade frame and lifting the plurality of upper poles until a sunshade reaches a desirable angle, and engaging the plurality of adjustable brackets of the sunshade frame to retain the sunshade at the desirable angle. Releasing a plurality of adjustable brackets of the sunshade frame can include loosening a plurality of twistable locks while engaging the plurality of adjustable brackets of the sunshade frame can include tightening the plurality of twistable locks. Alternatively, releasing a plurality of adjustable brackets of the sunshade frame can include removing a plurality of lock pins from the plurality of adjustable brackets while engaging the plurality of adjustable brackets of the sunshade frame can include inserting the plurality of lock pins into the plurality of adjustable brackets. As yet another example, releasing a plurality of adjustable brackets of the sunshade frame can include depressing a plurality of spring-loaded buttons of the plurality of adjustable brackets while engaging the plurality of adjustable brackets of the sunshade frame can include releasing the plurality of spring-loaded buttons.

In another example of the disclosed technology, a method of folding a portable chair can include releasing a plurality of adjustable brackets of a sunshade frame, gripping a plurality of upper poles of the sunshade frame and lowering the plurality of upper poles until a sunshade reaches a collapsed position. The method can further include removing a plurality of vertical supports of the sunshade frame from a plurality of attachment brackets of the portable chair, gripping opposing ends of the sunshade frame and pushing inwardly until the sunshade frame is collapsed, and gripping opposing ends of the portable chair and pushing inwardly until the portable chair is collapsed. Releasing a plurality of adjustable brackets of the sunshade frame can include loosening a plurality of twistable locks of the plurality of adjustable brackets. Alternatively, releasing a plurality of adjustable brackets of the sunshade frame can include removing a plurality of lock pins from the plurality of adjustable brackets. As yet another example, releasing a plurality of adjustable brackets of the sunshade frame can include depressing a plurality of spring-loaded buttons of the plurality of adjustable brackets.

The present disclosure will be more fully understood from the following detailed description of embodiments thereof, taken together with the drawings.

BRIEF DESCRIPTION OF THE DRAWINGS

While the specification concludes with claims, which particularly point out and distinctly claim the subject matter described herein, it is believed the subject matter will be better understood from the following description in conjunction with the accompanying drawings, in which like numerals indicate like structural elements and features in various figures. The drawings are not necessarily to scale, emphasis instead being placed upon illustrating principles of the disclosure. The figures depict one or more implementations of the inventive devices, by way of example only, not by way of limitation.

DETAILED DESCRIPTION

The features of the presently disclosed solution may be economically molded or assembled by using one or more distinct parts and associated components which, may be assembled together for removable or integral application. Unless defined otherwise, all terms of art, notations and other scientific terms or terminology used herein have the same meaning as is commonly understood by one of ordinary skill in the art to which this disclosure belongs.

In some cases, terms with commonly understood meanings are defined herein for clarity and/or for ready reference, and the inclusion of such definitions herein should not necessarily be construed to represent a substantial difference over what is generally understood in the art. All patents, applications, published applications and other publications referred to herein are incorporated by reference in their entirety. If a definition set forth in this section is contrary to or otherwise inconsistent with a definition set forth in the patents, application, published applications and other publications that are herein incorporated by reference, the definition set forth in this section prevails over the definition that is incorporated herein by reference.

As used herein, "a" or "an" means "at least one" or "one or more." As used herein, the term "user", "subject", "end-user" or the like is not limited to a specific entity or person.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

As used herein, the terms "about" or "approximately" for any numerical values or ranges indicate a suitable dimensional tolerance that allows the part or collection of components to function for its intended purpose as described herein. More specifically, "about" or "approximately" may refer to the range of values ±20% of the recited value, e.g. "about 90%" may refer to the range of values from 71% to 99%.

Figure 1:
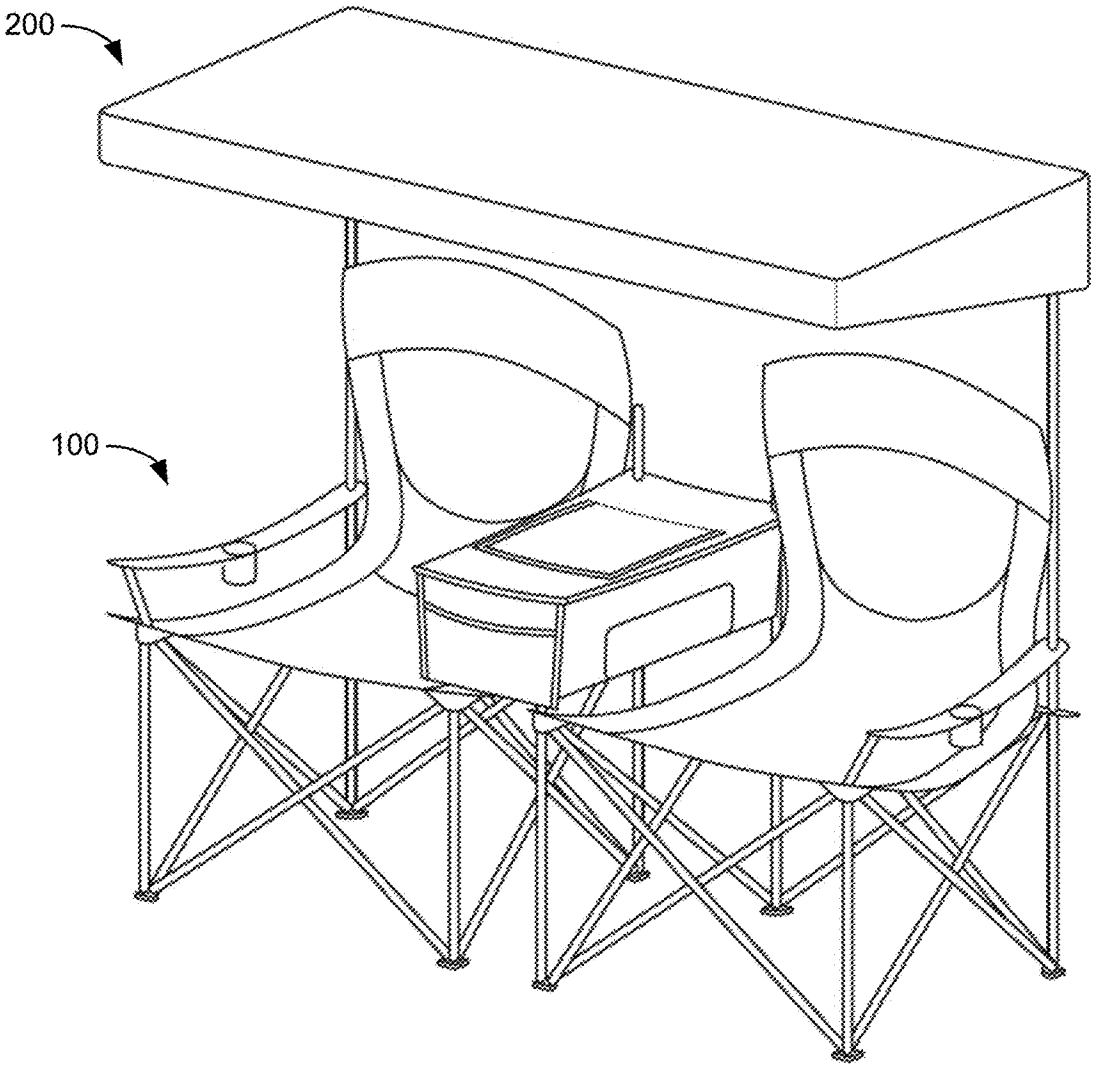
FIG. 1 illustrates a perspective view of a dual chair with sunshade, in accordance with an example of the disclosed technology.

FIG. 1 illustrates a perspective view of a dual chair 100 with sunshade 200, in accordance with an example of the disclosed technology. As will be appreciated, and as will become apparent through this description, the dual chair 100 can be configured to support at least two users sitting upon the dual chair 100. The dual chair 100, however, is not so limited and can be configured to support three, four, five, or more users as would be suitable for the particular application. Accordingly, it is to be understood that the dual chair 100 can provide a convenient sitting arrangement for multiple people. The dual chair 100 and sunshade 200 can be configured to transition between a deployed state (as depicted in FIG. 1) and a folded state such that the dual chair 100 and the sunshade 200 can be moved with relative ease from one location to another. As an example, the dual chair 200 can be folded and moved to a location where furniture is not normally available such as the beach, a sporting event, campsite, or other location. Furthermore, because the dual chair 100 and sunshade 200 can be folded, the dual chair 100 and sunshade 200 can be easily stored when not in use. As will become apparent throughout this disclosure, the sunshade 200 can be configured to be removed from the dual chair 100 such that the dual chair 100 and sunshade 200 can be used, moved, and/or stored separately, further adding to the ease of using the dual chair 100 and sunshade 200.

Figure 2A:
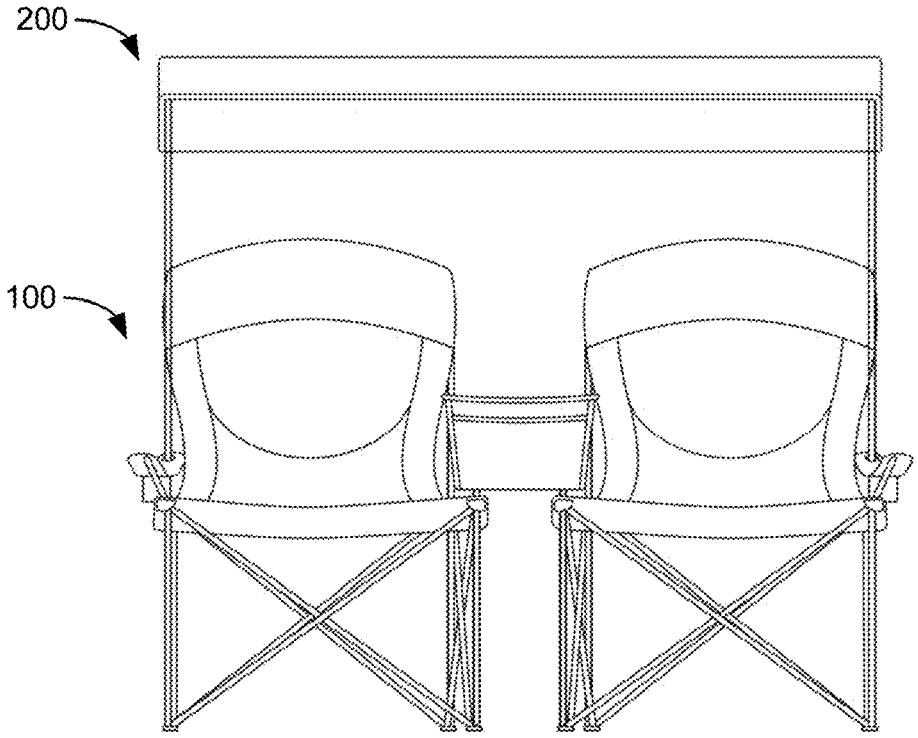
FIG. 2A illustrates a front view of a dual chair with sunshade, in accordance with an example of the disclosed technology.
Figure 2B:
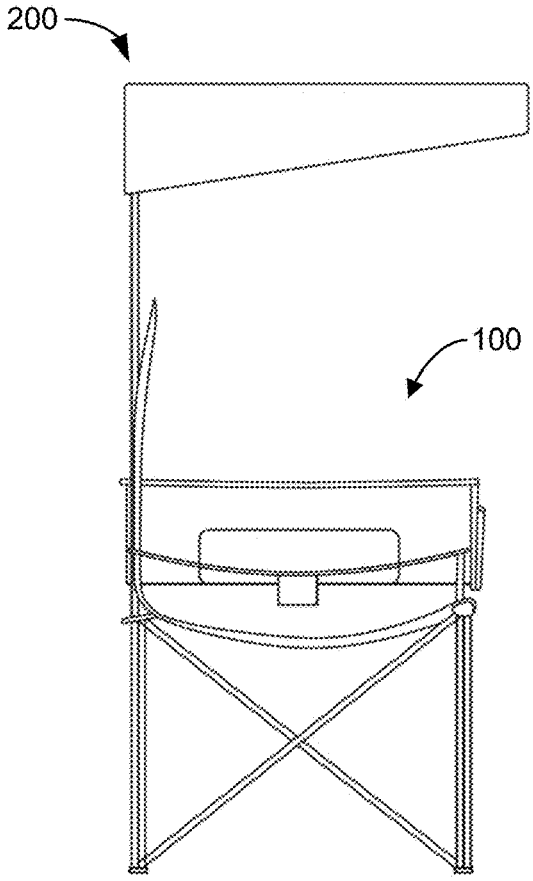
FIG. 2B illustrates a side view of a dual chair with sunshade, in accordance with an example of the disclosed technology.
Figure 3:
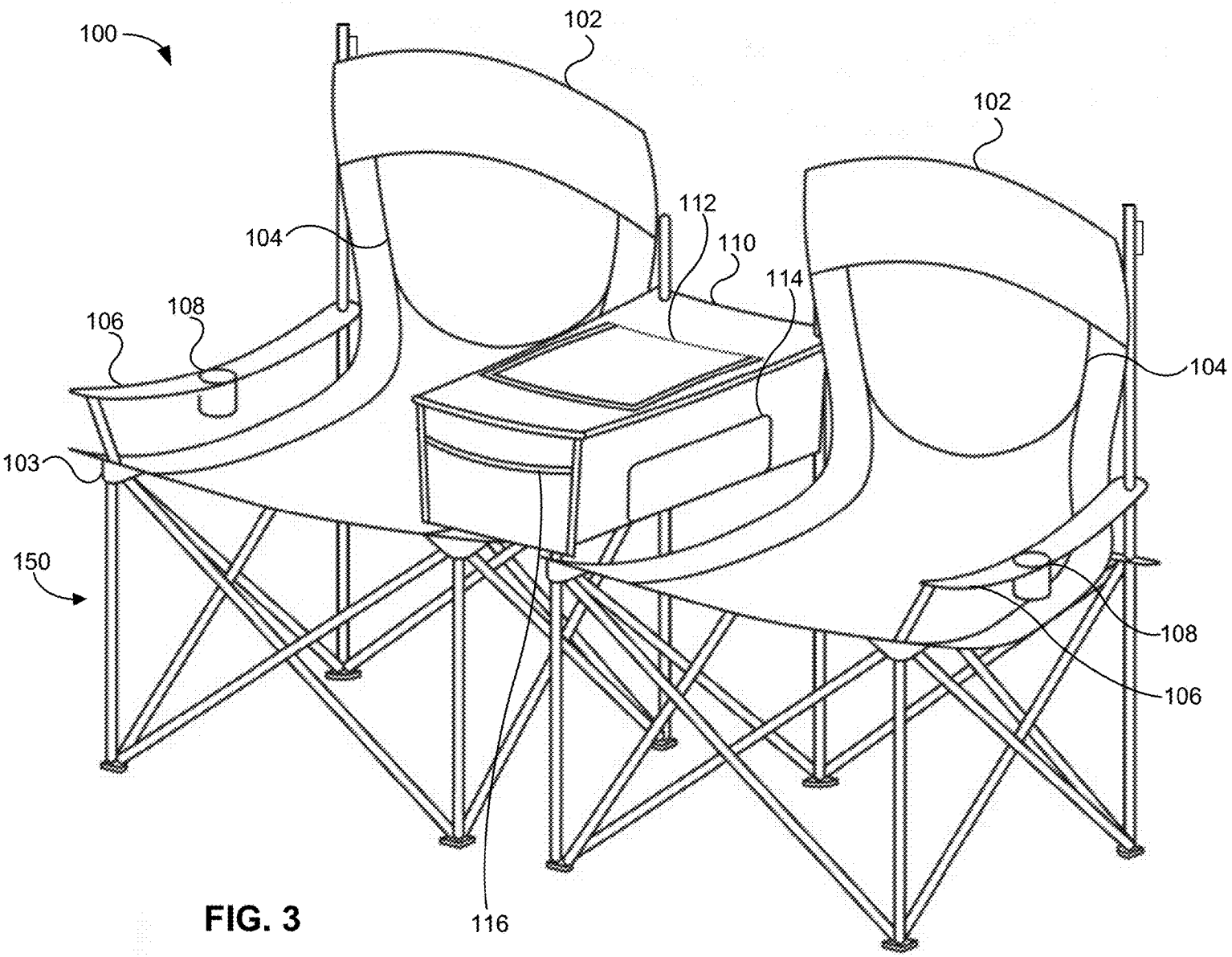
FIG. 3 illustrates a perspective view of a dual chair, in accordance with an example of the disclosed technology.

As depicted in FIGS. 1, 2, and 3, the sunshade 200 can be configured to be positioned above the dual chair 100 such that a user of the dual chair 100 can be shaded by the sunshade 200. Accordingly, the sunshade 200 can provide shade for a user seated upon the dual chair 100 without the need for the user to transport and set up a separate umbrella. Furthermore, as illustrated in FIGS. 1, 2, and 3, the sunshade 200 can be a substantially planar and substantially rectangular shape configured to provide shade to a user of the dual chair 200. Unlike the common rounded umbrellas that are unable to shade a substantially rectangular shape without being oversized, the substantially rectangular shape of the sunshade 200 can provide sufficient shade without requiring an unnecessary amount of space. This can be an advantage in situations where the user intends to use the dual chair 100 and sunshade 200 near other people or in locations with limited space. Furthermore, as will be described in greater detail herein, the sunshade 200 can be configured to be adjusted between a plurality of angles and heights such that sunshade 200 can be positioned to best provide shade to a user seated upon the dual chair 100. Alternatively, or in addition, because the sunshade 200 can be adjusted between a plurality of angles and heights, the sunshade 200 can be useful to provide privacy to a user of the dual chair 100.

FIG. 3 illustrates a perspective view of a dual chair 100, in accordance with an example of the disclosed technology. The dual chair 100 can comprise a chair support frame 150 configured to support a plurality of material pieces which, together with the chair support frame 150, form the dual chair 100. The material pieces described herein can comprise material capable of being folded while also capable of supporting a user when the dual chair 100 is in a deployed state. For example, and not limitation, the material pieces can comprise a fabric material, a plastic material, a cloth material, a mesh material, a composite material, or any other material capable of being folded and also supporting a user when in a deployed state. Furthermore, the material pieces can comprise an ornamental design having patterns, shapes, colors, trademarks, etc., and be treated with a solution to help prevent degradation caused by use of the dual chair 100 and exposure to wind, rain, sun, or other conditions that could degrade the material pieces.

The material pieces can include a seat material 102, a reinforcing material 103, a breathable material 104, an arm rest 106, a cup holder 108, a center compartment 110, a cooler 112, a side pouch 114, a front pouch 116, a top shade 202, a side shade 204, and a sunshade reinforcement 206. It is to be understood that all material pieces described herein can comprise any of the materials previously described and can include an ornamental design and/or be treated with a solution to help prevent degradation as previously described.

The seat material 102 can be affixed to the chair support frame 150 and be configured to form a seat for the user to sit upon. For example, the seat material 102 can be sized and shaped to support a user and distribute the load to the chair support frame 150 at locations where the seat material 102 is affixed to the chair support frame 150. The seat material 102 can be sized and shaped to form an ergonomic shape such that the dual chair 100 can provide a comfortable seat for a user. Furthermore, as depicted in FIG. 3, the seat material 102 can comprise at least two seat materials 102 such that the two seat materials 102 can provide at least two seats for a user to rest upon.

The seat material 102 can be configured to attach to the chair support frame 150 via a reinforcing material 103. The reinforcing material 103 can be affixed to the seat material 102 in locations where the seat material 102 is affixed to the chair support frame 150. The reinforcing material 103 can be the same material as the seat material 102. For example, the reinforcing material 103 can be multiple layers of the same type of material used to form the seat material 102. Alternatively, or in addition, the reinforcing material 103 can be a different type of material affixed to the seat material 102 and configured to reinforce the seat material 102. As will be appreciated, the reinforcing material 103 can be configured to help distribute the load created by the user sitting upon the seat material 102 to the chair support frame 150. By adding the reinforcing material 103 to locations where the seat material 102 is affixed to the chair support frame 150, the reinforcing material 103 can help to prevent the seat material 102 from tearing or ripping when a load is applied. The reinforcing material 103 can be affixed to the seat material 102 by stitching, adhesives, fusing, welding, molding, or by any other sufficient method of affixing the reinforcing material 103 to the seat material.

The seat material 102 can be affixed to a breathable material 104. The breathable material 104 can be affixed to the seat material 102 in locations where it would be advantageous to dissipate heat created by a user seated upon the dual chair 100. For example, the breathable material 104 can be affixed to the seat material 102 proximate a location where the user's back and/or backside would be located when seated upon the dual chair 100. By facilitating heat dissipation, the breathable material 104 can help to provide a comfortable experience for a user seated upon the dual chair 100.

The dual chair 100 can include an arm rest 106 affixed to the chair support frame 150. The arm rest 106 can be configured to support the arm of a user when the user is seated upon the dual chair 100. The arm rest 106 can also be configured to adjust between a plurality of heights to provide a comfortable experience for a user seated upon the dual chair 100. The arm rest 106 can be configured to include a cup holder 108 such that a user may place a drink, food, or other objects into the cup holder 108. As will be appreciated, the cup holder 108 can be sized and shaped to receive a cup, glass, bottle, or other container configured to contain a beverage or food such that the user is able to easily access the beverage or food.

The dual chair 100 can include a center compartment 110 positioned between at least two chairs formed by the seat material 102. The center compartment 110 can be sized and positioned to provide an additional rest for a user's arm in addition to the arm rest 106. The center compartment 110 can also be configured to include a center compartment 112, a side pouch 114, and a front pouch 116. As will become apparent throughout this disclosure, the center compartment 110 can provide a convenient storage or holding location for objects the user would like to store.

The center compartment 112 can a compartment configured to hold an object or multiple objects sized to fit within the center compartment 112. For example, the center compartment 112 can be sized to receive food, toys, books, electronic devices, sunscreen, or any other object that a user would wish to store within the center compartment 112. In another example, the center compartment 112 can be thermally insulated to thermally insulate the contents of the center compartment 112 from the ambient conditions. For example, the center compartment 112 can be a cooler configured to help keep contents within the center compartment 112 cool. As another example, the center compartment 112 can be a compartment configured to keep the contents within the center compartment 112 warm, such as heated food. Furthermore, the center compartment 112 can comprise a flap or lid configured to help retain and/or thermally insulate the objects within the center compartment 112. As an example, the center compartment 112 can include a zipper, a hook-and-loop fastener, a draw string, magnets, or other devices configured to help keep the center compartment 112 closed.

The center compartment 112 can include one or more side pouches 14 and one or more front pouches 116. The side pouch 114 and the front pouch 116 can each comprise a simple pocket sewn into the side or the front of the center compartment 112. The side pouch 114 and/or the front pouch 116 can be sized to receive various objects such as a magazine, an electronic device, a toy, a book, etc. Furthermore, the side pouch 114 and/or the front pouch 116 can comprise a waterproof pouch configured to protect the contents from liquid and sand that could damage the contents of the side pouch 114 and/or the front pouch 116. Furthermore, the side pouch 114 and/or the front pouch 116 can include a zipper, a hook-and-loop fastener, a drawstring, magnets, or other devices configured to help keep the side pouch 114 and/or the front pouch 116 closed. As yet another example, the side pouch 114 and/or the front pouch 116 can be thermally insulated similar to the center compartment 112.

Figure 4:
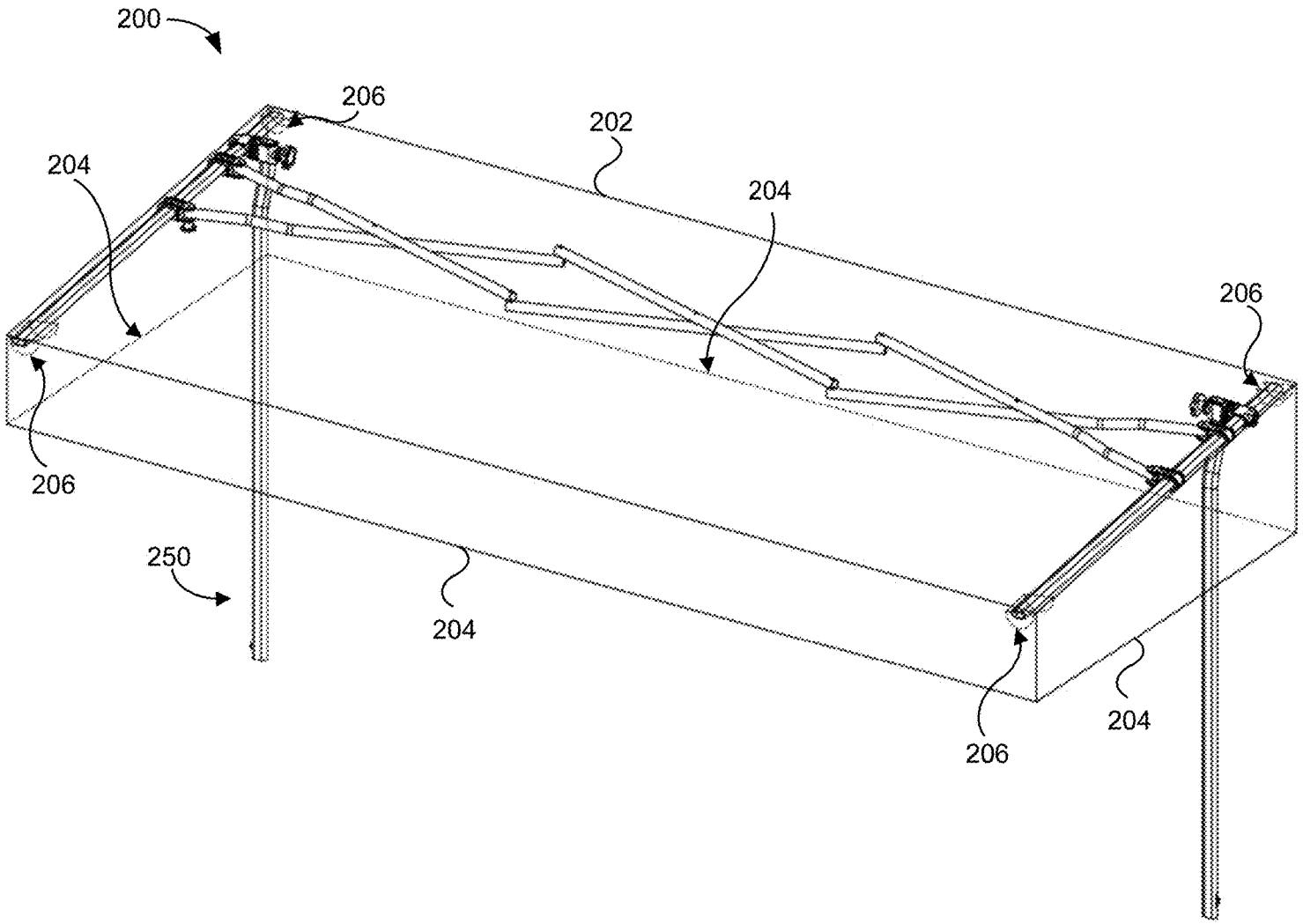
FIG. 4 illustrates a perspective view of a sunshade, in accordance with an example of the disclosed technology.

FIG. 4 illustrates a perspective view of a sunshade 200, in accordance with an example of the disclosed technology. The sunshade 200 can include a top shade 202 and a plurality of side shades 204 supported by, and affixed to, a sunshade support frame 250 such that the sunshade 200 can be configured to provide shade to a user of the dual chair 100. The top shade 202 can be substantially planar and substantially rectangular to provide shade to the user. Furthermore, as previously described, the top shade 202 and the plurality of side shades 204 can be or include the same materials, ornamental design, and/or treatment solution, etc. as the material pieces previously described. Although described in the context of being a sunshade 200, the sunshade 200 can serve the dual purpose of deflecting rain or other moisture away from a user seated below the sunshade 200. Furthermore, as described in greater detail herein, the top shade 202 and the plurality of side shades 204 can comprise an opaque material such that the sunshade 200 can provide privacy to a user of the dual chair 100.

The plurality of side shades 204 can be affixed to the top shade 202 and extend downwardly from the top shade 202 to further provide shade to a user seated upon the dual chair 100. As an example, the side shade 204 can extend downwardly from the top shade 202 a few inches on all sides of the top shade 202. As another example, the side shade 204 can extend downwardly from the top shade 202 a few inches on a front side of the top shade 202 and several inches or feet on the sides and back of the top shade 202. Similarly, the side shade 204 can extend downwardly from the top shade 202 on a side of the top shade 202 such that the side shade 204 is shorter proximate the front of the top shade 202 and longer proximate the back of the top shade 202. In this way, the sunshade 200 can provide shade, rain protection, and/or privacy while also allowing a user to be able see outward while seated in the dual chair 100. The plurality of side shades 204 can also be configured to be adjustable such that a user can extend or retract the side shades 204. For example, the side shades 204 can be configured to be rolled up and retained by straps when not in use. On the other hand, the side shades 204 can be configured to be extended downwardly when in use. Furthermore, the plurality of side shades 204 can be configured to be secured in place (e.g., with straps, hook-and-loop fasteners, zippers, etc.) when in use such that the side shades 204 are prevented from blowing in the wind or otherwise being moved from place.

The sunshade 200 can include a sunshade reinforcement material 206 configured to retain the sunshade 200 in place on the sunshade support frame 250. The sunshade reinforcement material 206 can comprise the same material as the top shade 202 and the side shade 204, or the sunshade reinforcement material 206 can be a different material affixed to the top shade 202 and/or the side shade 204. The sunshade reinforcement material 206 can be configured to create a sleeve or pocket for a portion of the sunshade support frame 250 be inserted into. Alternatively, or in addition, the sunshade reinforcement material 206 can be a strap of material configured retain the sunshade 200 in place. Furthermore, the sunshade reinforcement material 206 can be located proximate an end of the sunshade support frame 250 such that when a force is applied to the top shade 202 or the side shade 204, the sunshade reinforcement material 206 helps to prevent the top shade 202 or side shade 204 from being ripped, torn, or otherwise damaged.

Figure 5:
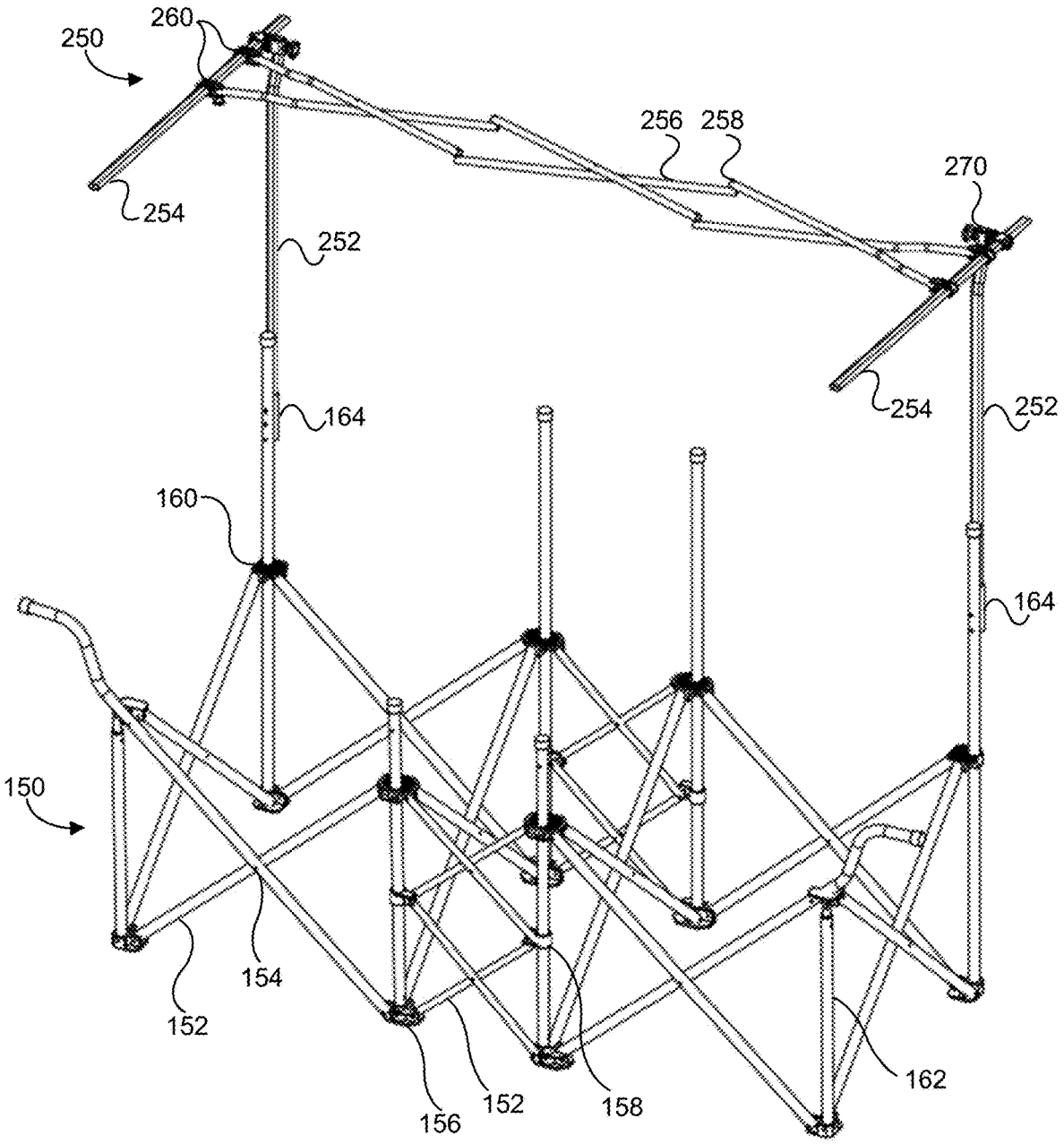
FIG. 5 illustrates a perspective view of a dual chair support frame and a sunshade support frame in a deployed state, in accordance with an example of the disclosed technology.

FIG. 5 illustrates a perspective view of a dual chair support frame 150 and a sunshade support frame 250 in a deployed state, in accordance with an example of the disclosed technology. The sunshade support frame 250 can be configured to attach to the dual chair support frame 150 such that the dual chair support frame 150 can support the sunshade support frame 250. In this way, the sunshade 200 can be configured to provide shade to a user seated upon the dual chair 100 without requiring a separate support or stand for the sunshade 200. Furthermore, the sunshade support frame 250 can be removeably attached to the chair support frame 150 such that the sunshade 200 can be removed from the dual chair 100.

Figure 6A:
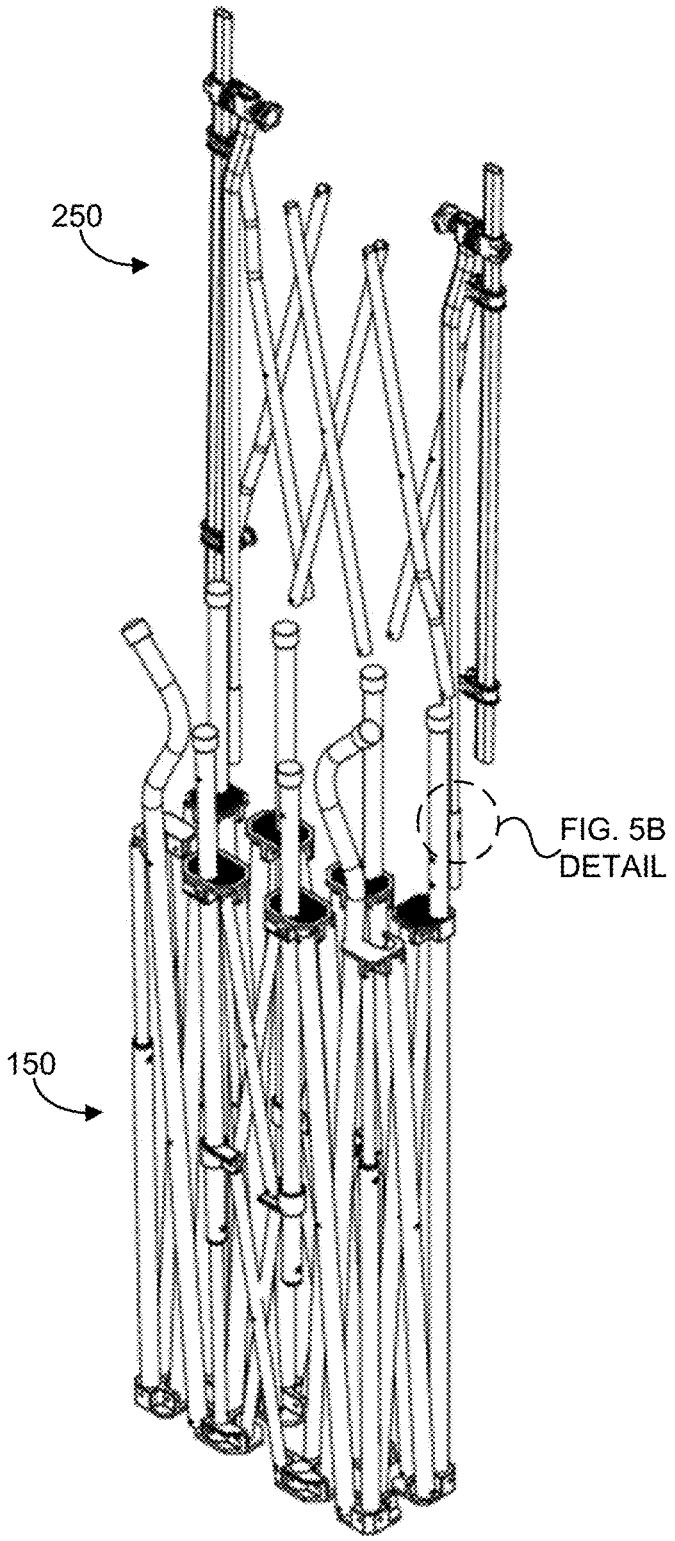
FIG. 6A illustrates a perspective view of a dual chair support frame and a sunshade support frame in a folded state, in accordance with an example of the disclosed technology.

The chair support frame 150 and sunshade support frame 250 can be configured to move between a deployed state (as depicted in FIG. 5) or a folded state (as depicted in FIG. 6A) together such that the dual chair 100 and sunshade 200 can be folded, transported, stored, and/or deployed together without needing to remove the sunshade 200. Alternatively, and as will described in greater detail herein, the sunshade support frame 250 can be removed from the chair support frame 150 such that sunshade support frame 250 and the chair support frame 150 can be individually folded, transported, stored and/or deployed (see FIGS. 7A-8C).

As depicted in FIG. 5, the chair support frame 150 can include a plurality of support poles 152 joined by pinned connections 154, pinned corner connections 156, sliding connections 158, sliding corner connections 160, and/or telescoping support poles 162 such that the plurality of support poles 152 can be affixed to each other and move in relation to each other. As will be appreciated, because the support poles 152 are able to move in relation to each other, the chair support frame 150 can move between a folded state and a deployed state. The support poles 152 can be made of material configured to support the weight of a user while also remaining relatively lightweight such that a user can tote the dual chair 100 without excessive effort. For example, the support poles 152 can be made from various lightweight metals, wood, composite materials, fiberglass, or any other suitable material for the application.

To facilitate transition of the chair support frame 150 between a deployed state and a folded state, the support poles can be configured to move in relation to each other in various ways. For example, one or more support poles 152 can be configured to rotate about a pinned connection 154. As another example, one or more support poles 152 can be configured to rotate about a pinned corner connection 156. As yet another example, the sliding connections 158 can be configured to slide along the length of a support pole 152. In still another example, the sliding corner connections 160 can be configured such that one or more support poles can remained connected to the sliding corner connection 160 while by rotating about a pinned joint of the sliding corner connection 160 while the sliding corner connection 160 slides along a support pole 152. In other example, the chair support frame 150 can include telescoping support poles 162 configured to include a support pole 152 with a large diameter and one or more support poles 152 with smaller diameters. In this way, the smaller telescoping support poles 152 can slide in and out of the larger telescoping support poles 152. As will be appreciated, the chair support frame 150 can be configured to include some or all of the elements just described to facilitate transitioning between a deployed state and a folded state. Furthermore, the various elements just described can be configured such that the dual chair 100 can be configured to support a user when the user is seated upon the dual chair 100.

Figure 6B:
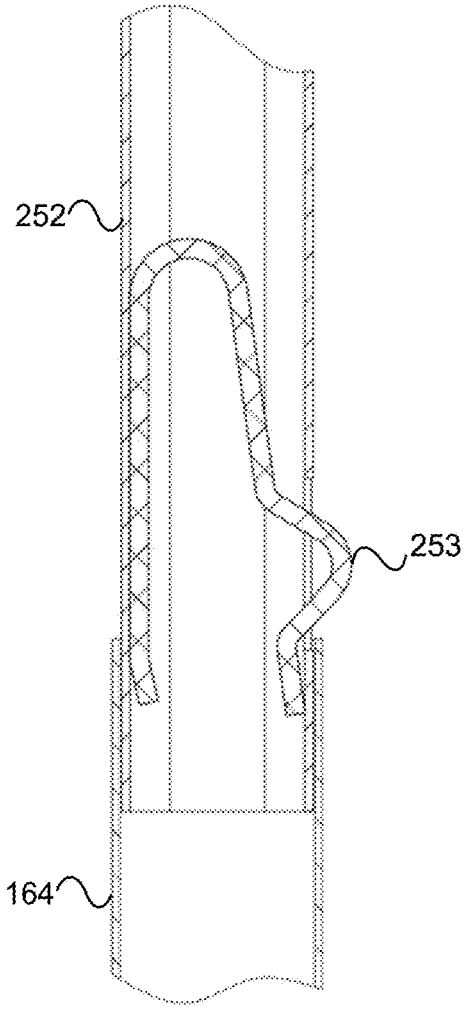
FIG. 6B illustrates an example sunshade connection point, in accordance with an example of the disclosed technology.
Figure 7A:
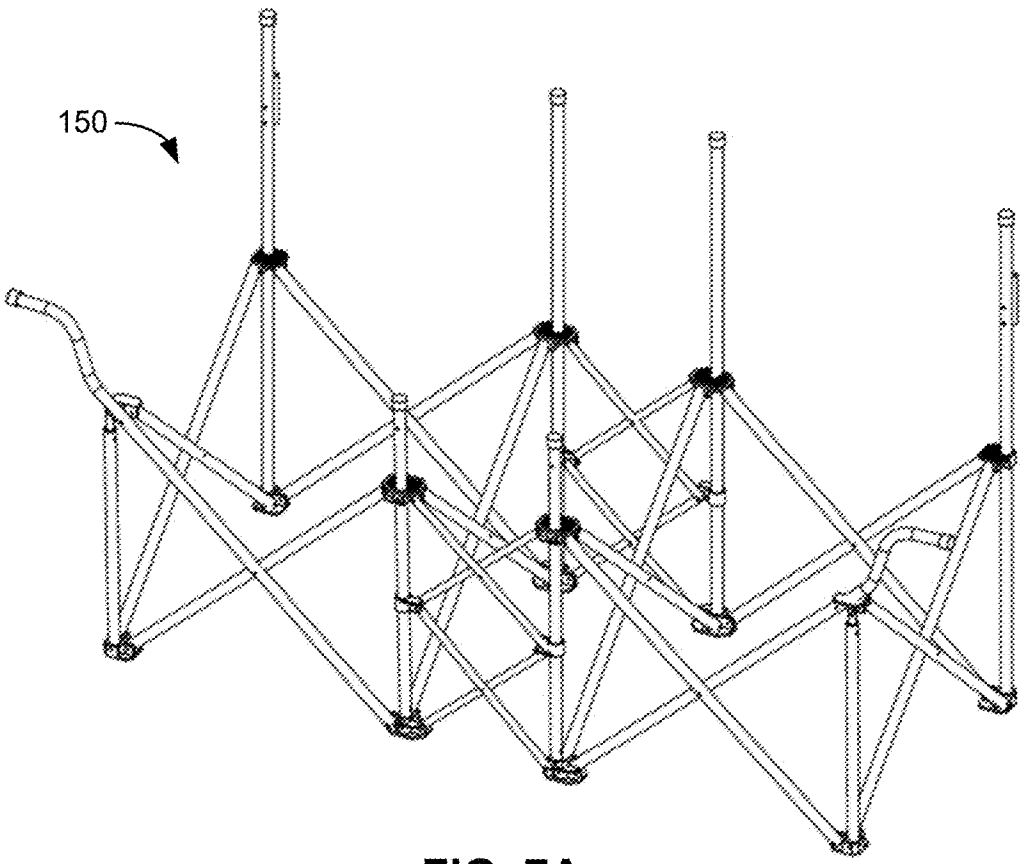
FIG. 7A illustrates a perspective view of a dual chair support frame in a deployed state, in accordance with an example of the disclosed technology.
Figure 7B:
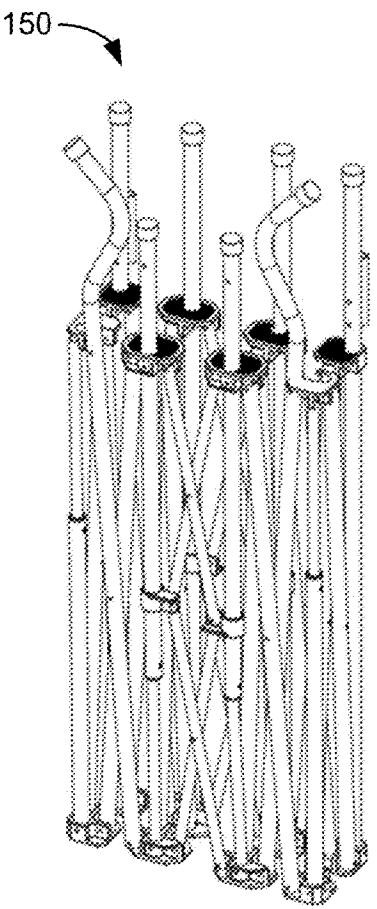
FIG. 7B illustrates a perspective view of a dual chair support frame in a folded state, in accordance with an example of the disclosed technology.

The sunshade support frame 250 can be configured to attach to the chair support frame 150 at a sunshade connection point 164. FIG. 6B illustrates a detailed section view of an example sunshade connection point 164, in accordance with an example of the disclosed technology. The chair support frame 150 can include the sunshade connection point 164 to receive the sunshade support frame 250 such that the chair support frame 150 can support the sunshade support frame 250. As depicted in FIG. 6B, the sunshade connection point 164 can be sized to receive a vertical support pole 252 of the sunshade support frame 250. The vertical support pole 252 can include a simple spring locking pin 253 configured to insert into a corresponding hole or slot on the sunshade connection point 164 such that the vertical support pole 252 is prevented from sliding out of the sunshade connection point 164. Furthermore, the sunshade connection point 164 can be sized to include multiple holes or slots such that the vertical support pole 252 can be inserted further into the sunshade connection point 164 by pushing in the spring locking pin 253. In this way, the sunshade connection point 164 can facilitate adjustment of the sunshade 200 between various heights above the chair support frame 150.

As will be appreciated, the sunshade connection point 164 depicted in FIG. 6B is offered only as an example sunshade connection point 164 and many other example sunshade connection points 164 could be used in place of the sunshade connection point 164 shown in FIG. 6B and described herein. For example, the sunshade connection point 164 can be used without the spring locking pin 253 and simply comprise a vertical support pole 254 sized to slide into or around the sunshade connection point 164 or even into or around a support pole 152 of the chair support frame 150. As another example, the sunshade connection point 164 could comprise a twistable knob configured to restrict movement of the vertical support pole 252 when tightened. As other examples, the sunshade connection point 164 can be or include a threaded connection, a press fit connection, a clamp connection, or any other suitable connection capable of supporting the sunshade 200 and also releasing the sunshade 200 from the dual chair 100.

To further facilitate adjustment of the height of the sunshade 200, the vertical support pole 252 can be configured with multiple telescoping pole sections configured to transition between an extended state and a collapsed state.

Alternatively, or in addition, the support pole 252 can comprise multiple spring locking pins 252 configured to be inserted into a hole or slot of the sunshade connection point 164.

The sunshade support frame 250 can include vertical support poles 252 that can be affixed to sunshade support poles 254 via a sunshade adjustment mechanism 270. The sunshade support poles 254 can be joined to the sunshade extension poles 256 via sliding extension pole connections 260 that are configured to slide along a length of the sunshade support poles 254 to facilitate folding of the sunshade 200. The sunshade support poles 256 can be affixed to each other by pinned joints 258 such that the sunshade support poles 256 can extend to a deployed position (as depicted in FIG. 5) while also folding to a folded position (as depicted in FIG. 6A). The vertical support poles 252, the sunshade support poles 254, and the sunshade extension poles 256 can each be made of the same material as the support poles 152 previously described.

Figure 8A:
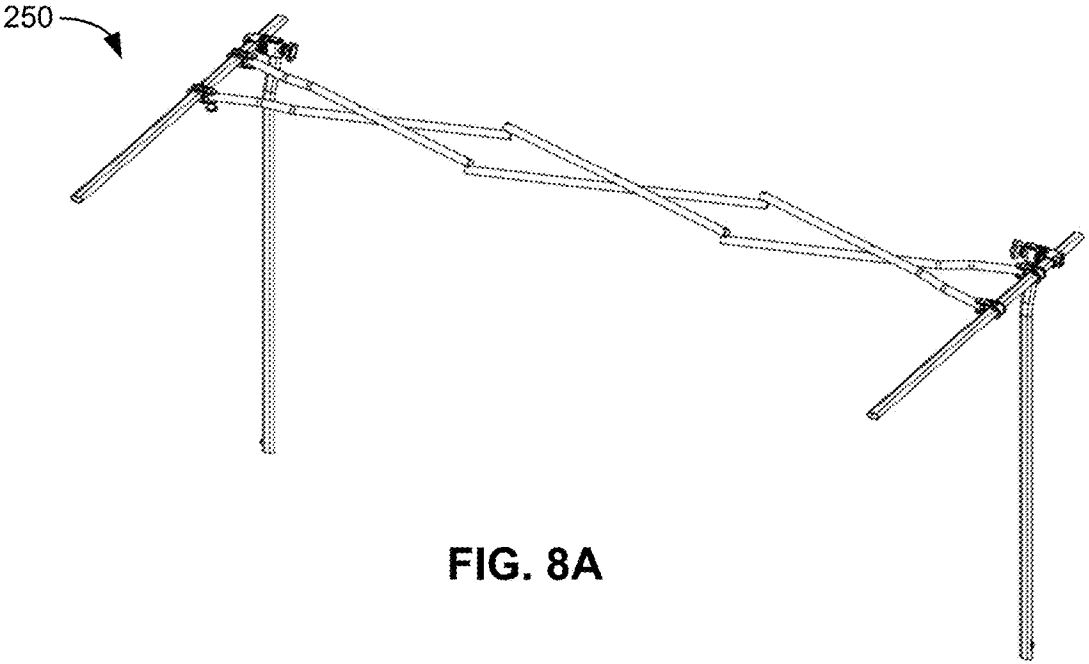
FIG. 8A illustrates a perspective view of a sunshade support frame in a deployed state, in accordance with an example of the disclosed technology.
Figure 8C:
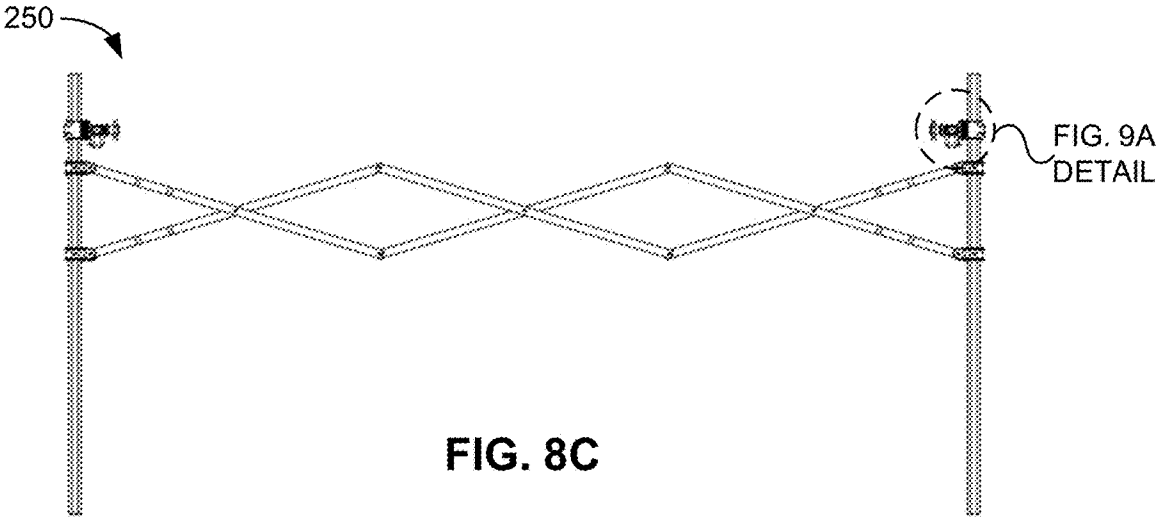
FIG. 8C illustrates a top view of a sunshade support frame in a deployed state, in accordance with an example of the disclosed technology.
Figure 8B:
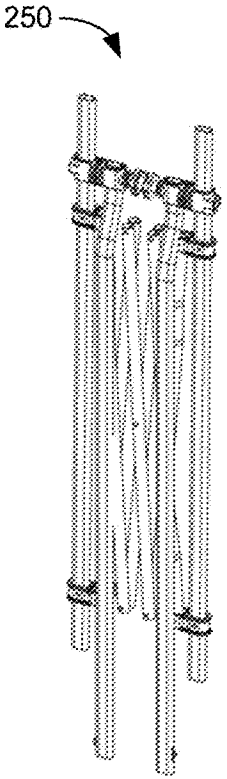
FIG. 8B illustrates a perspective view of a sunshade support frame in a folded state, in accordance with an example of the disclosed technology.

As depicted in FIGS. 8A-8C, the sunshade support frame 250 can be configured to be removed from the chair support frame 150 and be transitioned between a deployed state (as depicted in FIGS. 8A and 8C) and a folded state (as depicted in FIG. 8B) without the chair support frame 150. Furthermore, to facilitate adjustment of the angle of the sunshade 200 as well as transitioning between a deployed state and a folded state, the sunshade adjustment mechanism 270 can be configured to be adjustable such that the angle between the sunshade support poles 254 and the vertical support poles 252 can be adjusted.

Figure 9A:
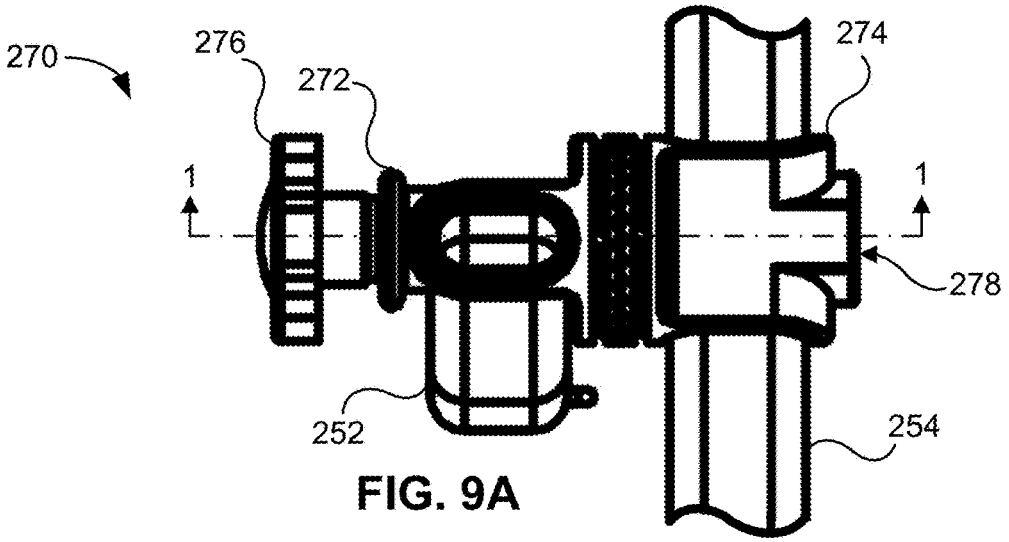
FIG. 9A illustrates a detailed view of a sunshade adjustment mechanism, in accordance with an example of the disclosed technology.

FIG. 9A illustrates a detailed view of a sunshade adjustment mechanism 270, in accordance with an example of the disclosed technology. The sunshade adjustment mechanism 270 can be or include an adjustable bracket having a vertical support pole connection 272, a sunshade support pole connection 274, an adjustment knob 276, and an adjustment screw 278. The vertical support pole connection 272 and the sunshade support pole connection 274 can each be a bracket connection configured to be affixed to the vertical support poles 252 or the sunshade support poles 254 respectively. Furthermore, the vertical support pole connection 272 and the sunshade support pole connection 274 can include raised edges or "teeth" (as depicted in FIGS. 9C and 9D) such that the raised edges of the vertical support pole connection 272 can interface with the raised edges of the sunshade support pole connection 274 to facilitate maintaining the sunshade 200 in place.

Figure 9B:
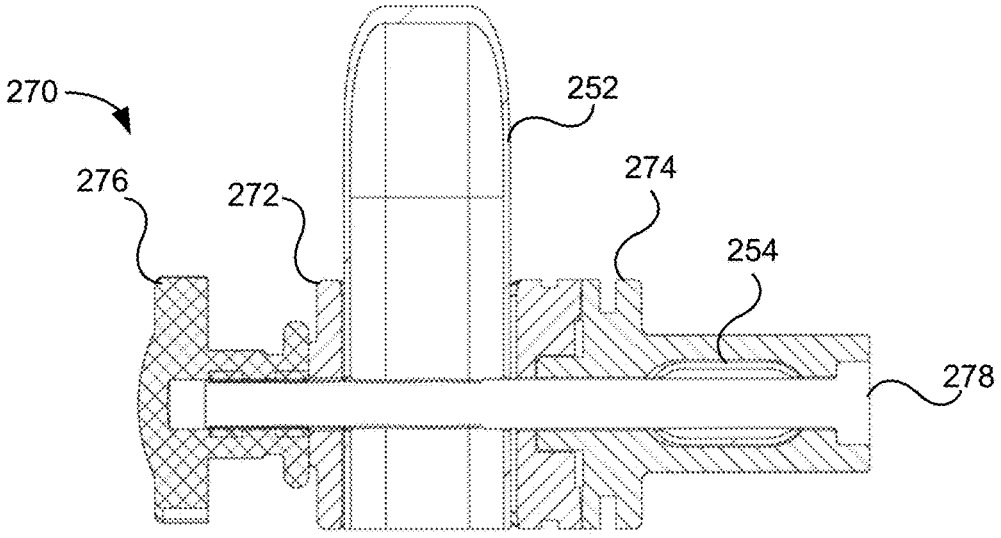
FIG. 9B illustrates a section view of a sunshade adjustment mechanism taken along section line 1-1 depicted in FIG. 9A, in accordance with an example of the disclosed technology.
Figure 9C:
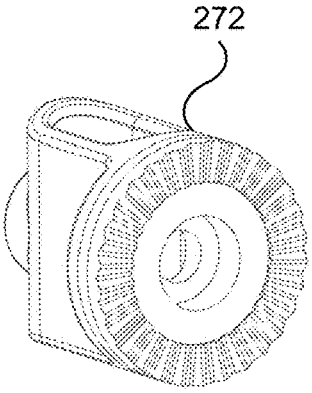
FIG. 9C illustrates a bracket connection of a sunshade adjustment mechanism, in accordance with an example of the disclosed technology.
Figure 9D:
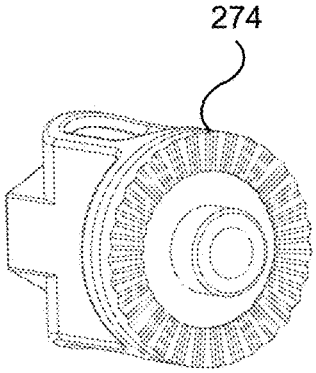
FIG. 9D illustrates another bracket connection of a sunshade adjustment mechanism, in accordance with an example of the disclosed technology.

FIG. 9B illustrates a section view of a sunshade adjustment mechanism 270 taken along section line 1-1 depicted in FIG. 9A, in accordance with an example of the disclosed technology. As will be appreciated, the sunshade adjustment mechanism 270 can include an adjustment knob 276 and an adjustment screw 278 that, together, can be loosened or tightened to facilitate adjustment of the angle of the sunshade 200. For example, a user can twist the adjustment knob 276 to loosen the sunshade adjustment mechanism 270 such that a gap can be created between the raised edges of the vertical support pole connection 272 and the sunshade support pole connection 274 and angle of the sunshade support pole 254 can be adjusted in relation to the vertical support pole 252. Once the sunshade 200 is in a preferred position, the user can tighten the adjustment knob 276 to secure the sunshade 200 in place.

As will be appreciated, the sunshade adjustment mechanism 270 just described is offered merely for explanatory purposes and other forms of adjustment mechanisms can be used in place of the sunshade adjustment mechanism 270 just described. For example, the sunshade adjustment mechanism 270 can be or include locking pins configured to be inserted into a hole of the vertical support pole connection 272 and the sunshade support pole connection 274 to retain the sunshade 200 in place. Alternatively, the sunshade adjustment mechanism 270 can include one or more spring-loaded releasable push buttons or pins. As another example, the sunshade adjustment mechanism 270 can be or include a spring-loaded adjustment knob. As yet another example, the sunshade adjustment mechanism 270 can be or include a friction fit interface between the vertical support pole connection 272 and the sunshade support pole connection 274 that can be adjustable. Further still, an example sunshade mechanism 270 can include a locking collar, a magnetic alignment bracket, a strap, or any other suitable adjustment mechanism configured to adjust an angle of the sunshade 200. As one of skill in the art will appreciate, the sunshade adjustment mechanism 270 can be or include any connecting mechanism configured to allow a user to adjust an angle of the sunshade 200. Furthermore, the sunshade adjustment mechanism 270 can be configured for a user to adjust the sunshade 200 between a plurality of angles, including approximately 90 degrees between the vertical support pole connection 272 and the sunshade support pole connection 274, approximately 180 degrees between the vertical support pole connection 272 and the sunshade support pole connection 274, approximately 270 degrees between the vertical support pole connection 272 and the sunshade support pole connection 274, approximately 360 degrees between the vertical support pole connection 272 and the sunshade support pole connection 274, and any angle therebetween.

To further facilitate adjustment of the angle of the sunshade 200, the sunshade connection point 164 can include an adjustable connection mechanism such that an angle of the vertical support pole 252 can be adjusted in relation to the chair support frame 150. If the sunshade connection point 164 is an adjustable connection mechanism, the adjustable connection mechanism can be or include the same mechanism as described here in relation to the sunshade adjustment mechanism 270. As will be appreciated, if the sunshade connection point 164 is an adjustable connection mechanism, the sunshade 200 can be configured to be folded downward such that the sunshade 200 can be beside the dual chair 100 when in a folded state. This can help to facilitate storing and toting the dual chair 100 and sunshade 200 in a more compact manner.

Figure 10:
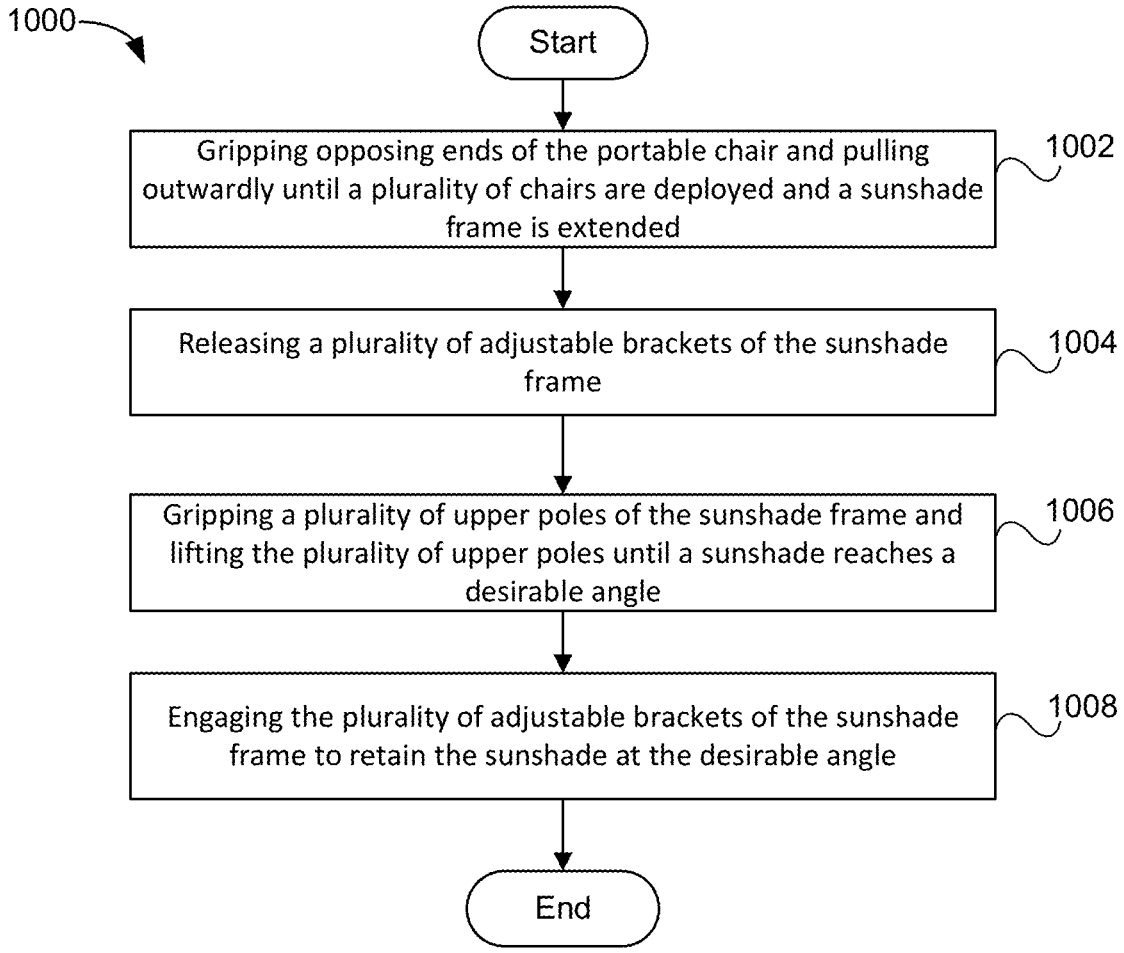
FIG. 10 is a flowchart illustrating a method of deploying a dual chair with sunshade, in accordance with an example of the disclosed technology.

FIG. 10 is a flowchart illustrating a method 1000 of deploying a dual chair (e.g., dual chair 100) with sunshade (e.g., sunshade 200), in accordance with an example of the disclosed technology. The method 1000 can include a user gripping 1002 opposing ends of the portable chair and pulling outwardly until a plurality of chair are deployed and a sunshade frame is extended. The method 1000 can include releasing 1004 a plurality of adjustable brackets or connections of the sunshade frame, gripping 1006 a plurality of upper poles (e.g., sunshade support poles 254) of the of the sunshade frame and lifting the plurality of upper poles until a sunshade reaches a desirable angle. The method 1000 can also include engaging 1008 the plurality of adjustable brackets of the sunshade frame to retain the sunshade at the desirable angle.

As will be appreciated, the method 1000 just described can be applied by a user to deploy a dual chair 100 and sunshade 200 from a folded state to a deployed state. In this example, the sunshade 200 can be attached to the dual chair 100 while in the folded state such that the user is not required to attach the sunshade 200 to the dual chair 100.

Figure 11:
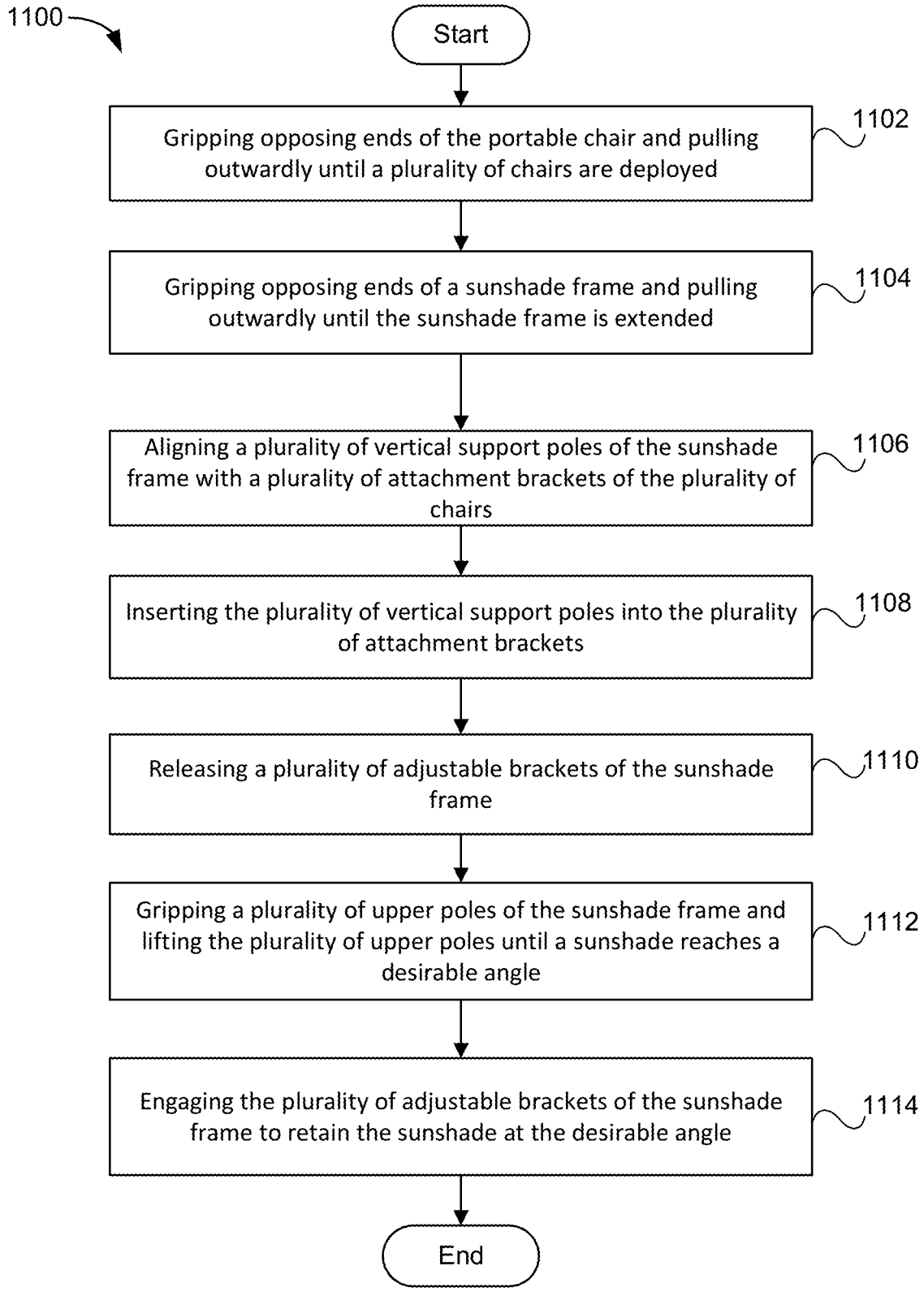
FIG. 11 is a flowchart illustrating another method of deploying a dual chair with sunshade, in accordance with an example of the disclosed technology.

FIG. 11 is a flowchart illustrating another method 1100 of deploying a dual chair (e.g., dual chair 100) with sunshade (e.g., sunshade 200), in accordance with an example of the disclosed technology. The method 1100 can include gripping 1102 opposing ends of the portable chair and pulling outwardly until a plurality of chairs are deployed. The method 1100 can include gripping 1104 opposing ends of a sunshade frame and pulling outwardly until the sunshade frame is extended. The method 1100 can further include aligning 1106 a plurality of vertical support poles of the sunshade frame with a plurality of attachment brackets of the plurality of chairs, inserting 1108 the plurality of vertical support poles into the plurality of attachment brackets, releasing 1110 a plurality of adjustable brackets of the sunshade frame, gripping 1112 a plurality of upper poles of the sunshade frame and lifting the plurality of upper poles until a sunshade reaches a desirable angle, and engaging 1114 the plurality of adjustable brackets of the sunshade frame to retain the sunshade at the desirable angle.

As will be appreciated, the method 1100 just described can be applied by a user to deploy a dual chair 100 and sunshade 200 from a folded state to a deployed state. In this example, the sunshade 200 can be initially detached from the dual chair 100 while in the folded state. The user can then attach the sunshade 200 to the dual chair 100 to deploy the dual chair 100 and the sunshade 200.

Figure 12:
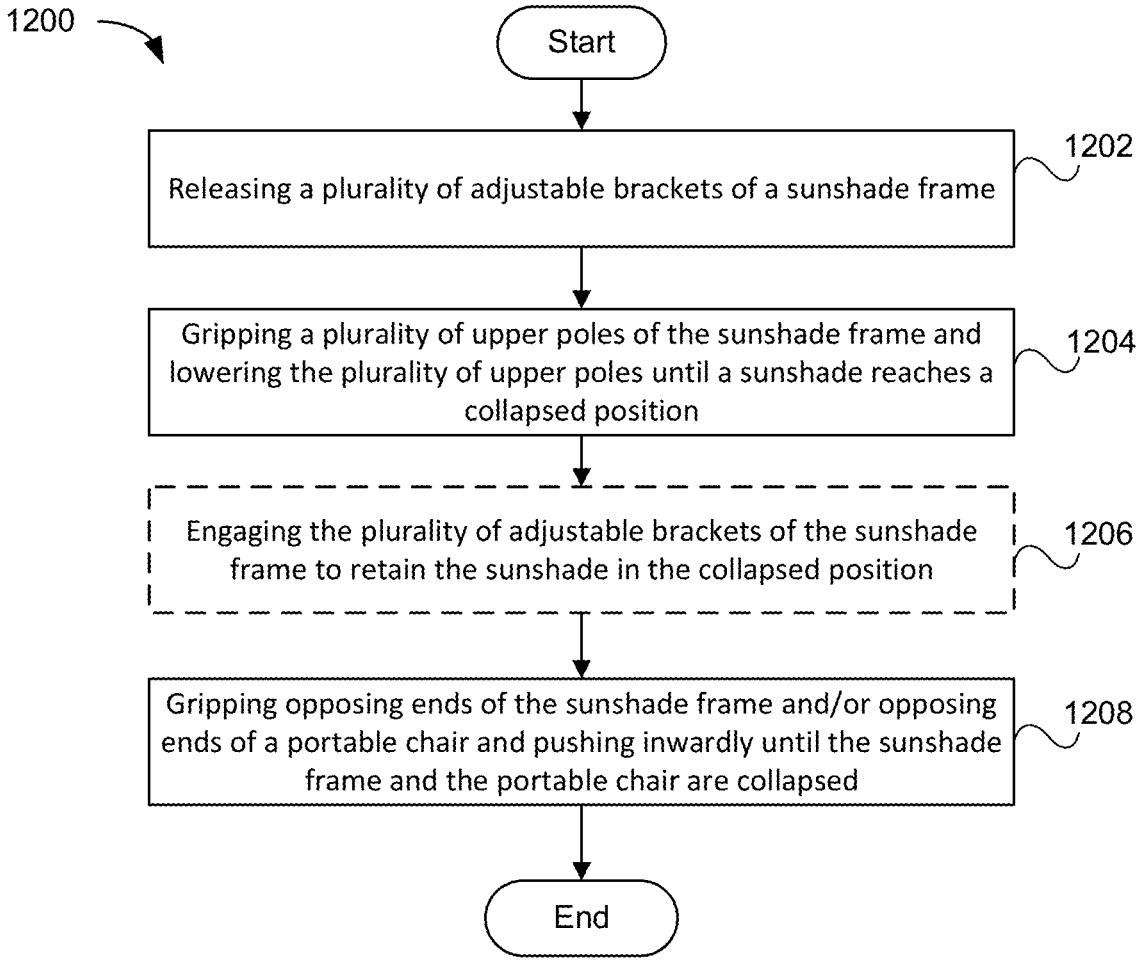
FIG. 12 is a flowchart illustrating a method of folding a dual chair with sunshade, in accordance with an example of the disclosed technology.

FIG. 12 is a flowchart illustrating a method 1200 of folding a dual chair (e.g., dual chair 100) with sunshade (e.g., sunshade 200), in accordance with an example of the disclosed technology. The method 1200 can include releasing 1202 a plurality of adjustable brackets of a sunshade frame and gripping 1204 a plurality of upper poles of the sunshade frame and lowering the plurality of upper poles until a sunshade reaches a collapsed position. Optionally, the method 1200 can include engaging 1206 the plurality of adjustable brackets of the sunshade frame to retain the sunshade in the collapsed position. The method can further include gripping 1208 opposing ends of the sunshade frame and/or opposing ends of a portable chair and pushing inwardly until the sunshade frame and the portable chair are collapsed.

As will be appreciated, the method 1200 just described can be applied by a user to fold a dual chair 100 and sunshade 200 from a deployed state to a folded state. In this example, the sunshade 200 can remain attached to the dual chair 100 such that the user is not required to detach the sunshade 200 from the dual chair 100.

Figure 13:
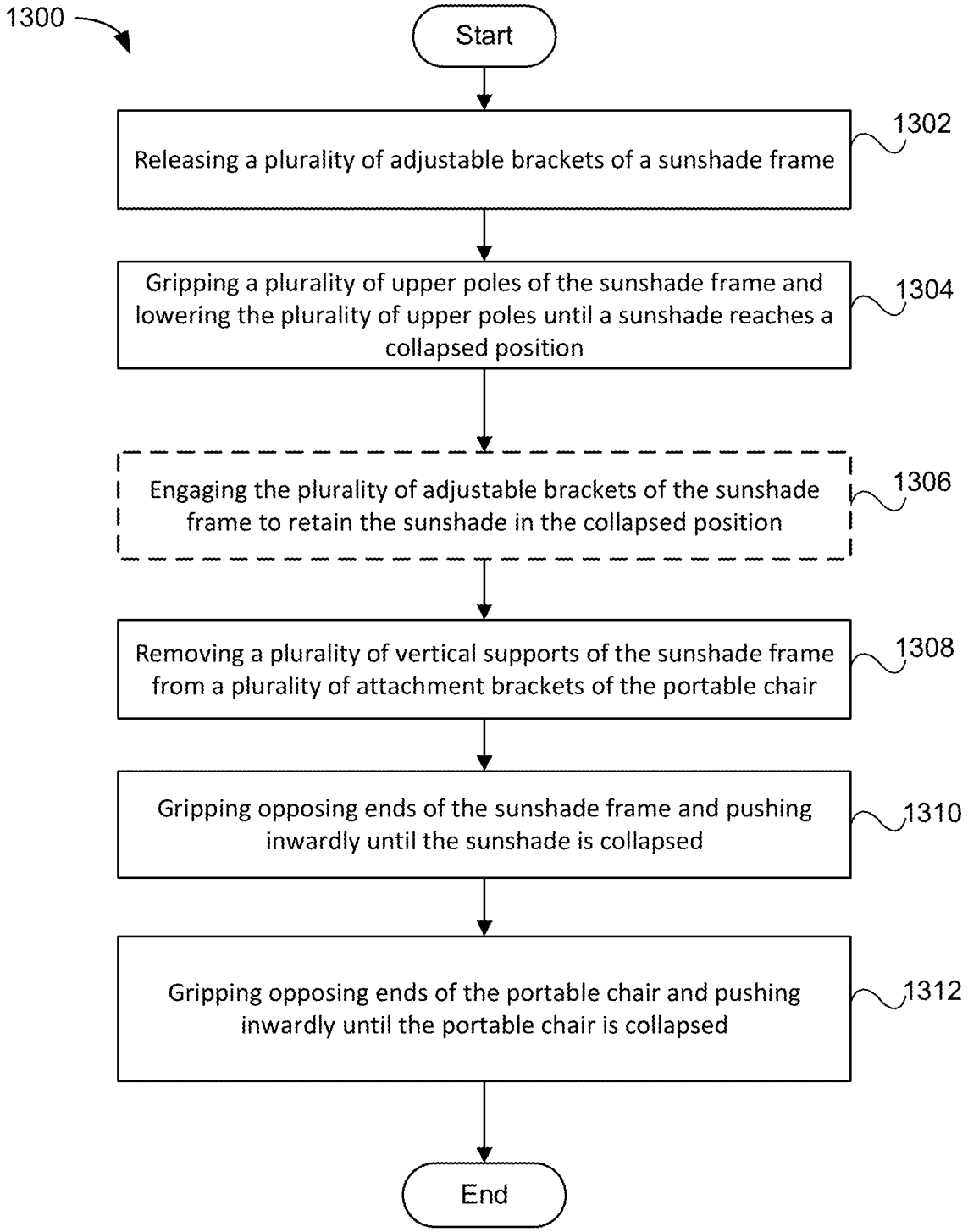
FIG. 13 is a flowchart illustrating another method of folding a dual chair with sunshade, in accordance with an example of the disclosed technology.

FIG. 13 is a flowchart illustrating another method 1300 of folding a dual chair (e.g., dual chair 100) with sunshade (e.g., sunshade 200), in accordance with an example of the disclosed technology. The method 1300 can include releasing 1302 a plurality of adjustable brackets of a sunshade frame and gripping 1304 a plurality of upper poles of the sunshade frame and lowering the plurality of upper poles until a sunshade reaches a collapsed position. Optionally, the method 1300 can include engaging 1306 the plurality of adjustable brackets of the sunshade frame to retain the sunshade in the collapsed position. The method 1300 can further include removing 1308 a plurality of vertical supports of the sunshade frame from a plurality of attachment brackets of the portable chair, gripping 1310 opposing ends of the sunshade frame and pushing inwardly until the sunshade is collapsed, and gripping 1312 opposing ends of the portable chair and pushing inwardly until the portable chair is collapsed.

As will be appreciated, the method 1300 just described can be applied by a user to fold a dual chair 100 and sunshade 200 from a deployed state to a folded state. In this example, the sunshade 200 can be detached from the dual chair 100 when the user folds the dual chair 100 and sunshade 200.

The methods 1000, 1100, 1200 and 1300 just described can be varied in accordance with the various elements and examples described herein. That is, methods in accordance with the disclosed technology can include all or some of the steps described above and/or can include additional steps not expressly disclosed above. Further, methods in accordance with the disclosed technology can include some, but not all, of a particular step described above. Further still, various methods described herein can be combined in full or in part. That is, methods in accordance with the disclosed technology can include at least some elements or steps of a first method (e.g., method 1000) and at least some elements or steps of a second method (e.g., method 1100).

The definitions of the words or elements of the following claims are, therefore, defined in this specification to not only include the combination of elements which are literally set forth. It is also contemplated that an equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination(s).

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what incorporates the essential idea of the embodiments.

What has been described above includes examples of one or more embodiments. It is, of course, not possible to describe every conceivable combination or subcombination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A dual folding chair system comprising:

a first plurality of rigid support poles joined by pins to form a collapsible chair support frame;

a plurality of fabric sections affixed to, and suspended by, the collapsible chair support frame to form a plurality of chairs, each chair of the plurality of chairs being configured to support a user when in a deployed state;

a second plurality of rigid support poles joined by pins to form a collapsible sunshade support frame, the second plurality of rigid support poles comprising a plurality of vertical support poles and a plurality of sunshade support poles;

a continuous fabric section affixed to, and supported by, the collapsible sunshade support frame and configured to form a substantially planar and substantially rectangular sunshade positioned above the collapsible chair support frame when in a deployed state;

a plurality of attachment brackets attached to the collapsible chair support frame and configured to receive the plurality of vertical support poles of the collapsible sunshade support frame such that the collapsible sunshade support frame is removably attached to the collapsible chair support frame;

a plurality of adjustable brackets affixed to the plurality of vertical support poles and the plurality of sunshade support poles, wherein the plurality of adjustable brackets are configured to (1) permit adjustment of the sunshade between a plurality of angles and (2) secure the sunshade at an angle of the plurality of angles, and a collapsible cooler attached to the collapsible chair support frame and configured to at least partially thermally insulate an object stored within the collapsible cooler.

2. The system of claim 1, wherein the plurality of adjustable brackets are configured to adjust the sunshade between a plurality of angles such that the plurality of sunshade support poles can be rotated substantially 90 degrees in relation to the plurality of vertical support poles between a deployed state and a collapsed state.

3. The system of claim 1, wherein the plurality of adjustable brackets are configured to adjust the sunshade between a plurality of angles such that the plurality of sunshade support poles can be rotated substantially 180 degrees in relation to the plurality of vertical support poles.

4. The system of claim 1, wherein each of the plurality of adjustable brackets comprises an adjustable angle bracket with a plurality of holes configured to receive a locking pin.

5. The system of claim 1, wherein each of the plurality of adjustable brackets comprises an adjustable angle bracket with a plurality of holes configured to receive a spring-loaded releasable push button.

6. The system of claim 1, wherein each of the plurality of adjustable brackets comprises bracket connections having raised edges, wherein the raised edges of each bracket connection are configured to align with raised edges of a corresponding bracket connection to prevent the sunshade support poles from moving in relation to the vertical support poles.

7. The system of claim 6, wherein the bracket connections, when the raised edges of each bracket connection are aligned with the raised edges of the corresponding bracket connection, are configured to be secured in place with a threaded connection.

8. The system of claim 6, wherein the bracket connections, when the raised edges of each bracket connection are aligned with the raised edges of the corresponding bracket connection, are configured to be secured in place with a spring-loaded tension knob.

9. The system of claim 1, wherein the collapsible sunshade support frame can be collapsed with the collapsible chair support frame while attached to the collapsible chair support frame.

10. The system of claim 1, wherein the collapsible sunshade support frame can be deployed with the collapsible chair support frame while attached to the collapsible chair support frame.

11. The system of claim 1, the collapsible cooler further comprising a top opening wherein a user can access the object within the cooler.

12. The system of claim 11, the top opening comprising at least one of a zipper, a hook and loop fastener, and a magnetic fastener.

13. A method of erecting a portable chair, the method comprising:

gripping opposing ends of the portable chair and pulling outwardly until a plurality of chairs and a collapsible cooler are deployed, the collapsible cooler being attached to the plurality of chairs and configured to at least partially thermally insulate an object stored within the collapsible cooler;

gripping opposing ends of a sunshade frame and pulling outwardly until the sunshade frame is extended;

aligning a plurality of vertical support poles of the sunshade frame with a plurality of attachment brackets of the plurality of chairs;

inserting the plurality of vertical support poles into the plurality of attachment brackets;

releasing a plurality of adjustable brackets of the sunshade frame;

gripping a plurality of upper poles of the sunshade frame and lifting the plurality of upper poles until a sunshade reaches a desirable angle; and engaging the plurality of adjustable brackets of the sunshade frame to retain the sunshade at the desirable angle.

14. The method of claim 13, wherein releasing a plurality of adjustable brackets of the sunshade frame comprises loosening a plurality of twistable locks of the plurality of adjustable brackets, and wherein engaging the plurality of adjustable brackets of the sunshade frame comprises tightening the plurality of twistable locks.

15. The method of claim 13, wherein releasing a plurality of adjustable brackets of the sunshade frame comprises removing a plurality of lock pins from the plurality of adjustable brackets, and wherein engaging the plurality of adjustable brackets of the sunshade frame comprises inserting the plurality of lock pins into the plurality of adjustable brackets.

16. The method of claim 13, wherein releasing a plurality of adjustable brackets of the sunshade frame comprises depressing a plurality of spring-loaded buttons of the plurality of adjustable brackets, and wherein engaging the plurality of adjustable brackets of the sunshade frame comprises releasing the plurality of spring-loaded buttons.

17. A method of folding a portable chair, the method comprising:

releasing a plurality of adjustable brackets of a sunshade frame;

gripping a plurality of upper poles of the sunshade frame and lowering the plurality of upper poles until a sunshade reaches a collapsed position;

removing a plurality of vertical supports of the sunshade frame from a plurality of attachment brackets of the portable chair;

gripping opposing ends of the sunshade frame and pushing inwardly until the sunshade frame is collapsed; and gripping opposing ends of the portable chair and pushing inwardly until the portable chair and a collapsible cooler are both collapsed, the collapsible cooler being attached to the portable chair and configured to at least partially thermally insulate an object stored within the collapsible cooler.

18. The method of claim 17, wherein releasing a plurality of adjustable brackets of the sunshade frame comprises loosening a plurality of twistable locks of the plurality of adjustable brackets.

19. The method of claim 17, wherein releasing a plurality of adjustable brackets of the sunshade frame comprises removing a plurality of lock pins from the plurality of adjustable brackets.

20. The method of claim 17, wherein releasing a plurality of adjustable brackets of the sunshade frame comprises depressing a plurality of spring-loaded buttons of the plurality of adjustable brackets.

* * * * *